US010627197B2

(12) United States Patent
Kozlik et al.

(10) Patent No.: US 10,627,197 B2
(45) Date of Patent: Apr. 21, 2020

(54) MECHANICAL BROADHEAD WITH PIVOTING BLADE

(71) Applicants: Christopher A. Kozlik, Schaumburg, IL (US); Keith Beam, Waunakee, WI (US)

(72) Inventors: Christopher A. Kozlik, Schaumburg, IL (US); Keith Beam, Waunakee, WI (US)

(73) Assignee: GSM, LLC, Houston, TX (US)

( * ) Notice: Subject to any disclaimer, the term of this patent is extended or adjusted under 35 U.S.C. 154(b) by 0 days.

(21) Appl. No.: 16/131,852

(22) Filed: Sep. 14, 2018

(65) Prior Publication Data

US 2019/0086186 A1 Mar. 21, 2019

Related U.S. Application Data

(60) Provisional application No. 62/559,185, filed on Sep. 15, 2017.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | | |
|---|---|---|---|---|---|
| 5,046,744 | A * | 9/1991 | Eddy | F42B 6/08 | 473/583 |
| 5,100,143 | A * | 3/1992 | Puckett | F42B 6/08 | 473/583 |
| 5,359,984 | A | 11/1994 | Simo | | |
| 5,458,341 | A * | 10/1995 | Forrest | F42B 6/08 | 473/583 |
| 5,526,799 | A | 6/1996 | Simo | | |
| 5,564,713 | A * | 10/1996 | Mizek | F42B 6/08 | 473/583 |
| 5,722,381 | A | 3/1998 | Mizek | | |
| 6,050,251 | A | 4/2000 | Harwath et al. | | |
| 7,377,869 | B2 * | 5/2008 | Wohlfeil | F42B 6/08 | 473/583 |
| 9,417,039 | B2 * | 8/2016 | Rowley | F42B 6/08 | |
| 10,082,373 | B2 * | 9/2018 | Romero | F42B 6/08 | |
| 2019/0033048 | A1 * | 1/2019 | Sullivan | F42B 12/34 | |

* cited by examiner

*Primary Examiner* — John A Ricci
(74) *Attorney, Agent, or Firm* — Pauley Erickson & Kottis

(57) ABSTRACT

A mechanical arrowhead or broadhead with pivoting blades that each pivot between an in-flight position and an impact position. One or more blades is each mounted within an opening of a body so that each blade pivots or otherwise moves with respect to the body. A stop element is secured directly to or with respect to the body. In the impact position, each blade contacts the stop element. In the in-flight position, each blade does not contact but rather is arranged or positioned away from the stop element.

19 Claims, 9 Drawing Sheets

MECHANICAL BROADHEAD WITH PIVOTING BLADE

CROSS REFERENCE TO RELATED APPLICATION

This patent application claims the benefit of Provisional U.S. Patent Application Ser. No. 62/559,185, filed 15 Sep. 2017. This Provisional patent application is hereby incorporated by reference herein in its entirety and is made a part hereof, including but not limited to those portions which specifically appear in this specification.

BACKGROUND OF THE INVENTION

Field of the Invention

This invention relates to a mechanical broadhead with pivoting blades that each pivot between an in-flight position and an impact position.

Discussion of Related Art

Some blade-opening mechanical broadheads or arrowheads have blades which move from a closed position, for example, when an arrow is launched from a bow and during flight of the arrow and then each blade moves into an open position, for example, when the arrow contacts a target. In many conventional mechanical broadheads or arrowheads, blades move from a closed position or flight position to an open position or cutting position.

In some conventional mechanical broadheads or arrowheads, blades are maintained in a closed position or an in-flight position by retaining members, such as spring elements, O-rings or retaining bands.

In some conventional mechanical arrowheads, blades responsively move from a closed position to an open position by applying a force to an actuation portion of the blade.

There is an apparent need for an expandable arrowhead or broadhead that positively holds, maintains or keeps each blade of a blade-opening arrowhead in the closed position or the retracted position during launch and flight of an archery arrow. There is also an apparent need for an apparatus, method and/or system that can be used to enhance or improve the ability for conventional expandable arrowheads or broadheads to maintain each blade in the closed position, particularly during launch and flight of an archery arrow.

SUMMARY OF THE INVENTION

In some embodiments of the blade-opening or expandable arrowhead according to this invention, the blades move or pivot between the expanded position and the retracted position. In some embodiments of the expandable arrowhead according to this invention, a spring element and/or another suitable holding element, such as a wave washer, a rubber band or an O-ring is used to hold a pivotably mounted blade in an in-flight or retracted position, particularly while encountering the relatively high forces generated at and through an arrow and a corresponding arrowhead when launched from an archery bow, until impact with a target at which time each blade moves to the expanded or impact position. In other embodiments according to this invention, the spring element, the wave washer and/or other holding element can be added to conventional blade-opening arrowheads or broadheads, to improve the capability and performance and thus allow each blade to remain in the in-flight or closed position until impact with the target. In other embodiments according to this invention, an O-ring is used in addition to or in lieu of the spring element. In other embodiments of this invention, the O-ring is used in combination with an interference fit between a blade and a ferrule body.

In some embodiments according to this invention, a blade-carrying body has a slot within a ferrule body or other suitable blade-carrying body. At least one blade is pivotally mounted within the slot. It is possible to mount two or more blades within each slot. Each blade has an impact portion that receives an impact force upon contact with the target and also a cutting portion that is exposed to the target when the blade is in the expanded position. Each blade is designed to move from the in-flight or retracted position to the impact or expanded position when the impact force traveling through the blade overcomes a resistance bias force exerted by the holding element, for example, the wave washer or the spring element on the blade and/or by other resistance force or other force acting on the blade, such as by an O-ring or other suitable structure or element.

In some embodiments of this invention, the cutting portion of each blade is positioned or located opposite of the impact portion, for example so that the cutting portion is on one side and the impact portion is on another side of the body and/or the slot of the body. The spring element, the O-ring, the cutting portion, the impact portion and/or the shape and dimensions of the blade, the blade-carrying body, and/or the slot can be varied to accommodate different desired cutting patterns and/or blade opening capabilities of the broadhead.

In some embodiments of this invention, one or more shafts each is fixedly mounted within the slot of the blade-carrying body. Each shaft can be secured with respect to the blade-carrying body when the blade moves between the retracted position and the expanded position. The shaft fixed within the slot prevents the blade from translating or moving in a generally linear direction with respect to the blade-carrying body. In some embodiments, having the shaft fixedly mounted within the slot allows each blade to pivot about the shaft or to move in a radial direction about the shaft, and in such embodiments each blade can move along or follow a pivoting movement path when the blade moves between the in-flight or retracted position and the impact or expanded position.

In some embodiments, the shaft pivots or otherwise radially moves with respect to the blade-carrying body when the blade moves between the retracted position and the expanded position. In some embodiments of this invention, when the shaft is fixedly mounted with respect to the blade-carrying body, the spring element can be mounted directly to or with respect to the body and thus does not move with the blade, with respect to the body.

The spring element or other suitable holding element of this invention can be used in combination with other elements of this invention and/or can be used as an improvement to conventional blade-opening arrowheads or broadheads. In some embodiments of this invention, the spring element is used in lieu of or in combination with an interference fit between the blade and the blade-carrying body.

Moving the blade from the closed position to the open position can increase a cutting diameter of the arrowhead. The shape and/or size of each blade and/or of each arm can be selected or designed to achieve any desired cutting diameter.

DETAILED DESCRIPTION OF THE INVENTION

Figure 1:
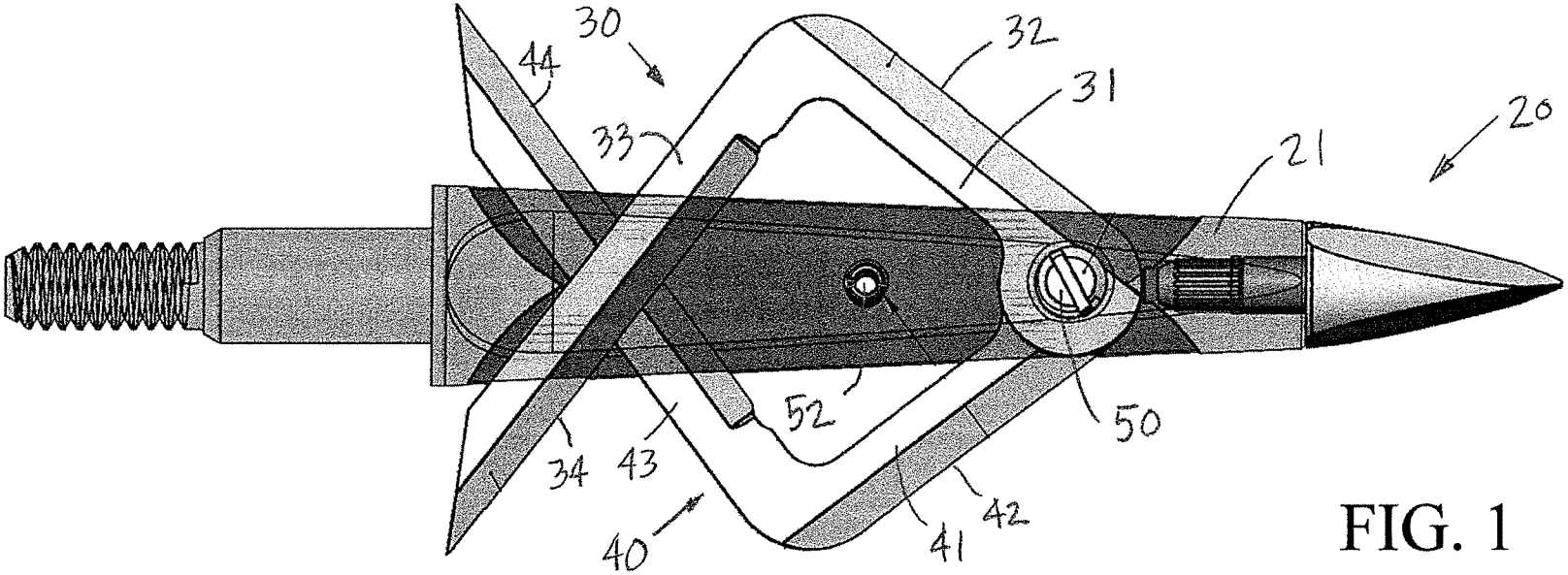
FIG. 1 is a transparent side view of a mechanical broadhead in a launch position, according to one embodiment of this invention.
Figure 3:
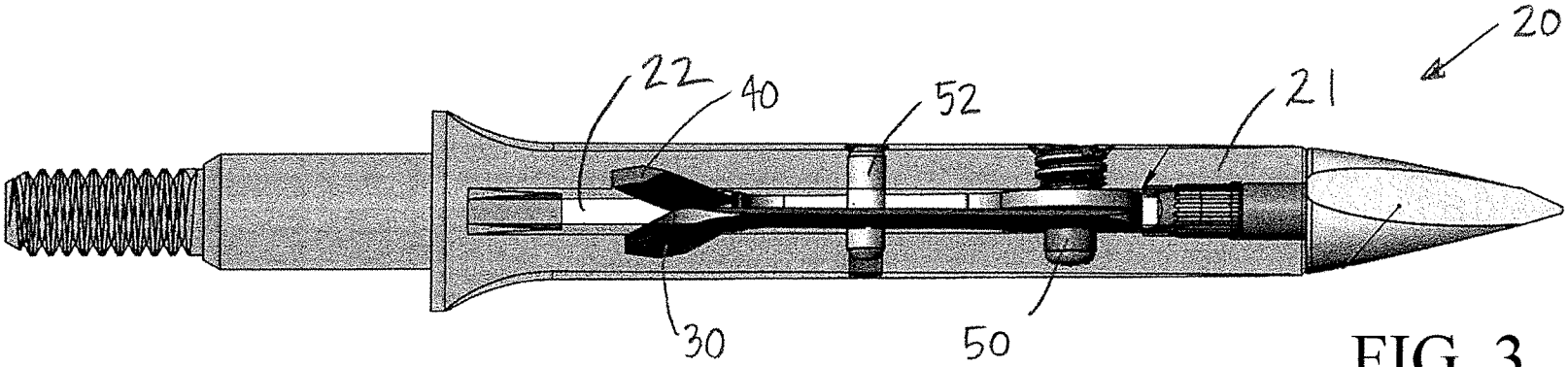
FIG. 3 is a transparent top view of a mechanical broadhead, according to one embodiment of this invention.
Figure 2:
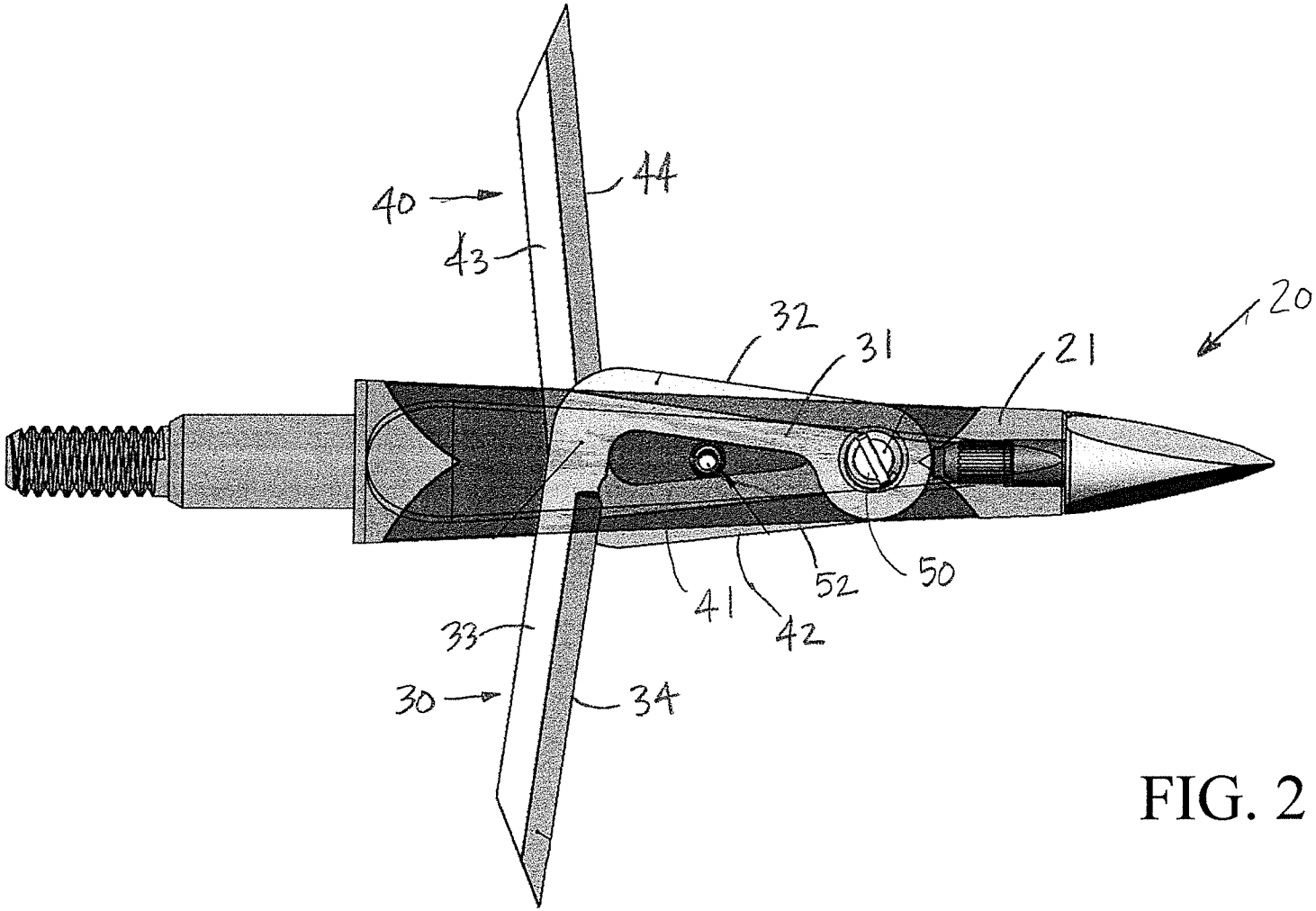
FIG. 2 is a transparent side view of a mechanical broadhead in an impact position, according to the embodiment shown in FIG. 1.
Figure 4:
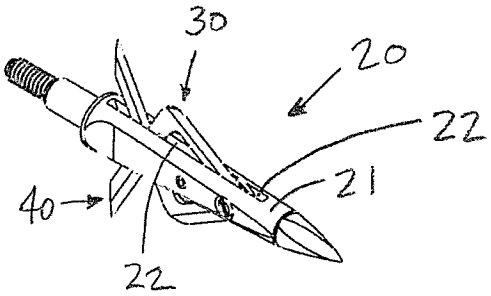
FIG. 4 is a perspective view of a mechanical broadhead in a pre-launch or in-flight position, according to one embodiment of this invention.
Figure 6:
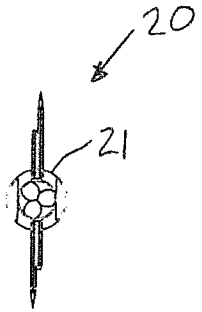
FIG. 6 is a front view of the mechanical broadhead, as shown in FIG. 4.
Figure 5:
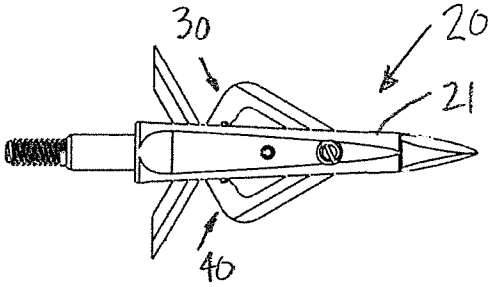
FIG. 5 is a side view of the mechanical broadhead, as shown in FIG. 4.
Figure 7:
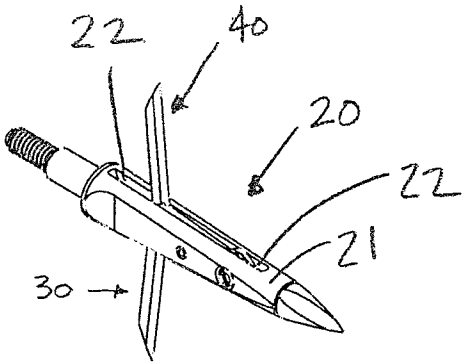
FIG. 7 is a perspective view of a mechanical broadhead in an impact position, according to one embodiment of this invention.
Figure 9:
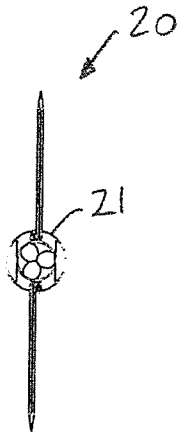
FIG. 9 is a front view of the mechanical broadhead, as shown in FIG. 7.
Figure 8:
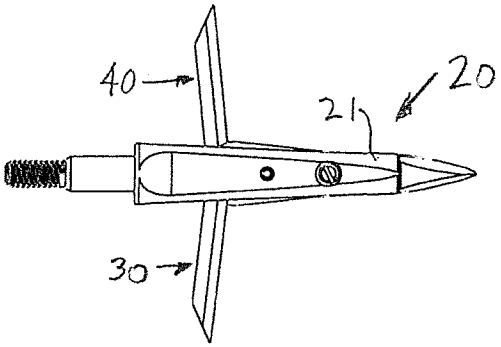
FIG. 8 is a side view of the mechanical broadhead, as shown in FIG. 7.
Figure 10:
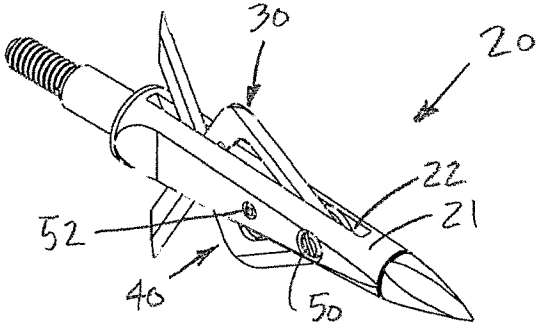
FIG. 10 is a perspective view of a mechanical broadhead in a pre-launch or in-flight position, according to one embodiment of this invention.
Figure 12:
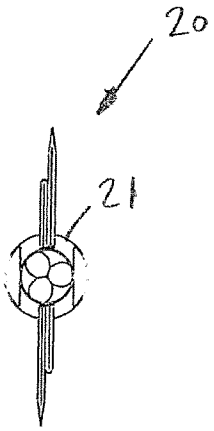
FIG. 12 is a front view of the mechanical broadhead, as shown in FIG. 10.
Figure 11:
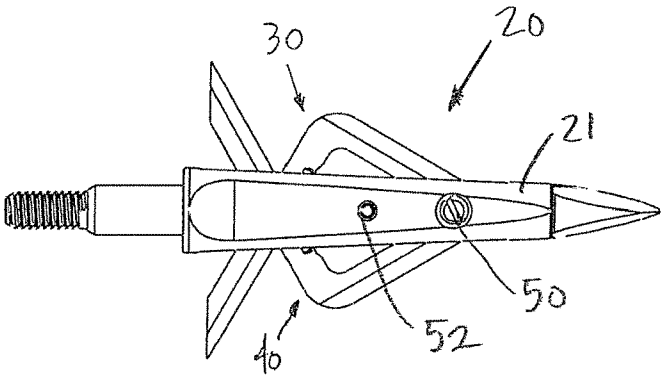
FIG. 11 is a side view of the mechanical broadhead, as shown in FIG. 10.
Figure 13:
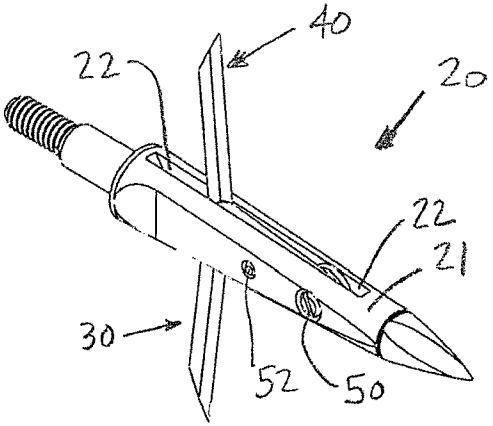
FIG. 13 is a perspective view of a mechanical broadhead in an impact position, according to one embodiment of this invention.
Figure 15:
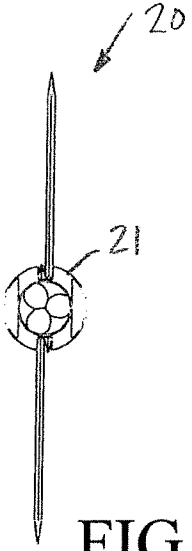
FIG. 15 is a front view of the mechanical broadhead, as shown in FIG. 13.
Figure 14:
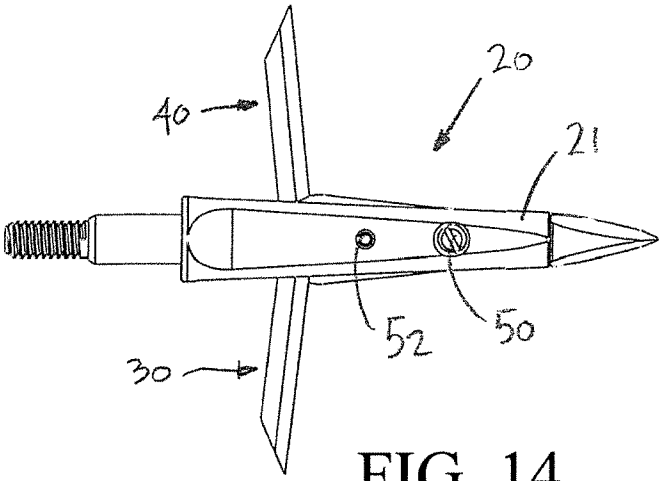
FIG. 14 is a side view of the mechanical broadhead, as shown in FIG. 13.
Figure 16:
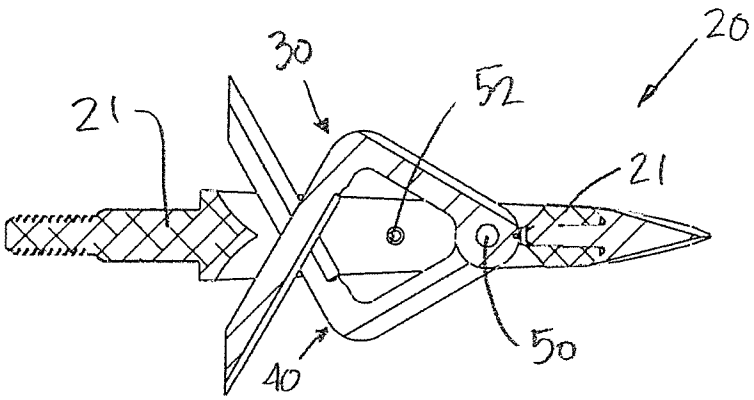
FIG. 16 is a sectional view of a mechanical broadhead in a pre-launch or in-flight position, according to one embodiment of this invention.
Figure 17:
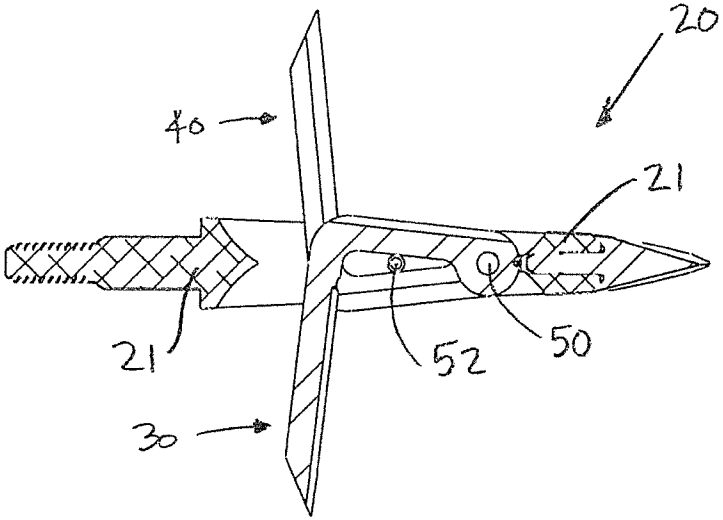
FIG. 17 is a sectional view of mechanical broadhead as shown in FIG. 16 but in an impact position.

FIG. 1 shows broadhead 20 in a launch, a pre-launch or an in-flight position or condition, according to one embodiment of this invention. FIG. 1 shows one arrangement for broadhead 20 before and after a time when broadhead 20 is discharged from an archery bow and in flight, for example, on a path to a target. FIG. 2 shows broadhead 20 in an impact or target contact position or condition. When broadhead 20 contacts or makes impact with a target or a target material, forces acting upon broadhead 20 cause broadhead 20 to transition or change from the in-flight position to the impact position, as discussed further in this specification.

In some embodiments of this invention, broadhead 20 comprises or has at least one blade. As shown in FIGS. 1 and 2, broadhead 20 comprises 2 blades 30 and 40 mounted within opening 22, according to some embodiments of this invention. Opening 22 can be a through bore, a bore, a cavity and/or any other suitable void within the structure of body 21 of broadhead 20 that allows each blade 30 and 40 to move with respect to body 21.

In some embodiments of this invention, each blade, such as blades 30 and 40 as shown in FIGS. 1 and 2, is pivotally mounted within or with respect to opening 22 in body 21. In some embodiments of this invention, each blade 30 and 40 has a width that is generally wider than a thickness of the blade.

Figure 19:
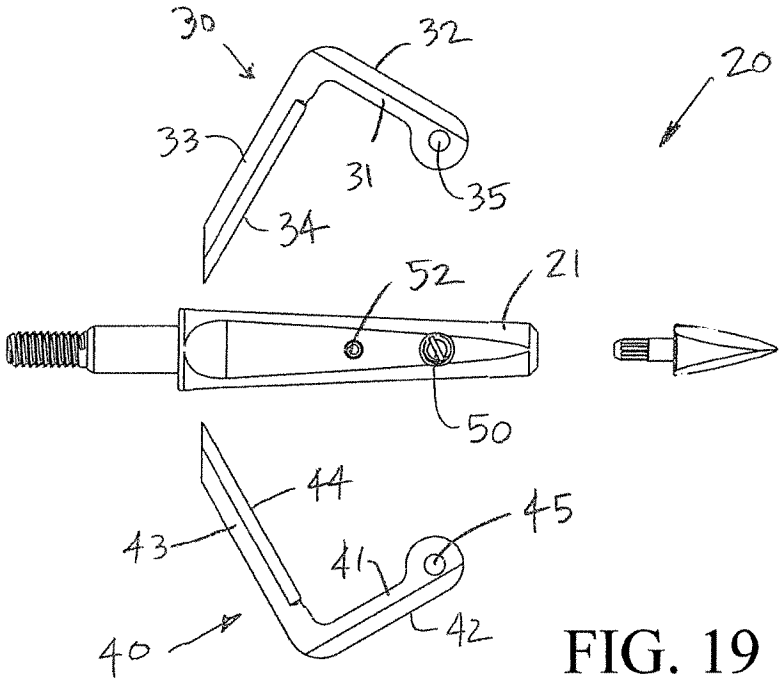
FIG. 19 is an exploded side view of the mechanical broadhead as shown in FIG. 18.
Figure 18:
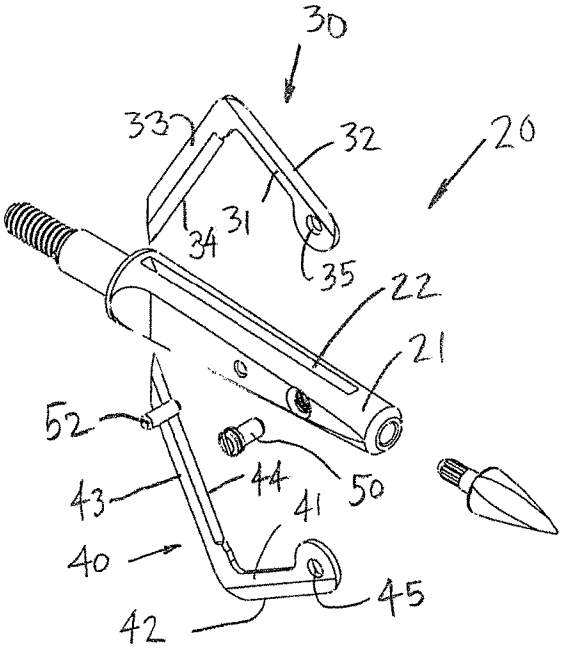
FIG. 18 is an exploded perspective view of a mechanical broadhead, according to one embodiment of this invention.
Figure 20:
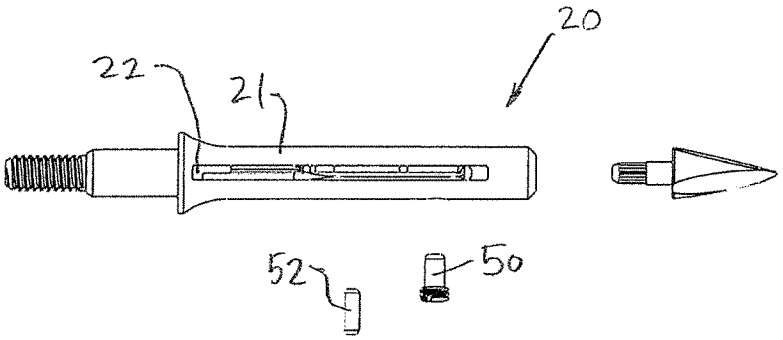
FIG. 20 is an exploded top view of the mechanical broadhead as shown in FIG. 18.

According to some embodiments of this invention, for example as shown in FIGS. 18-20, blade 30 has a profile or overall shape in which first section 31 is positioned or disposed generally perpendicular to second section 33 and has bore 35, such as a through bore, at, near or adjacent first section 31. In some embodiments of this invention, first section 31 has first edge 32, which in some embodiments of this invention can be a cutting edge, positioned or disposed on an outside or outer portion of the generally perpendicular profile of blade 30. In some embodiments of this invention, second section 33 comprises or has second edge 34, which in some embodiments of this invention can be a cutting edge, positioned or disposed on an inside or inner portion of the generally perpendicular profile of blade 30.

According to some embodiments of this invention, for example as shown in FIGS. 18-20, blade 40 has a profile or overall shape in which first section 41 is positioned or disposed generally perpendicular to second section 43 and has bore 45, such as a through bore, at, near or adjacent first section 41. In some embodiments of this invention, first section 41 has first edge 42, which in some embodiments of this invention can be a cutting edge, positioned or disposed on an outside or outer portion of the generally perpendicular profile of blade 40. In some embodiments of this invention, second section 43 comprises or has second edge 44, which in some embodiments of this invention can be a cutting edge, positioned or disposed on an inside or inner portion of the generally perpendicular profile of blade 40.

In some embodiments of this invention, each blade 30 or 40 is mounted, such as pivotally mounted, within opening 22 with pivot 50 or another suitable pivot structure, such as a pivot screw or any other suitable pivoting structure, and through bore 35 or 45, such as near or adjacent first section 31 or 41, and in some embodiments of this invention, so that first section 31 or 41 extends through opening 22 on or to a first side of opening 22 and second section 33 or 43 extends through opening 22 on or to a second side of opening 22. In some embodiments of this invention, blade 30 is positioned within opening 22 so that first section 31 extends through or to the first side of opening 22 and first section 31 extends through or to the second side of opening 22 which can be positioned opposite from the first side of opening 22.

According to some embodiments of this invention, any suitable retaining device or retention apparatus, such as a spring clip, a friction member, a rubber band and/or any other suitable retainer or retaining member can be mounted near, adjacent, along and/or about at least one blade 30 and/or 40, for example, to resist, restrict and/or inhibit rotation of blades 30 and/or 40 about pivot 50 for blade 30 and/or 40.

Figure 21:
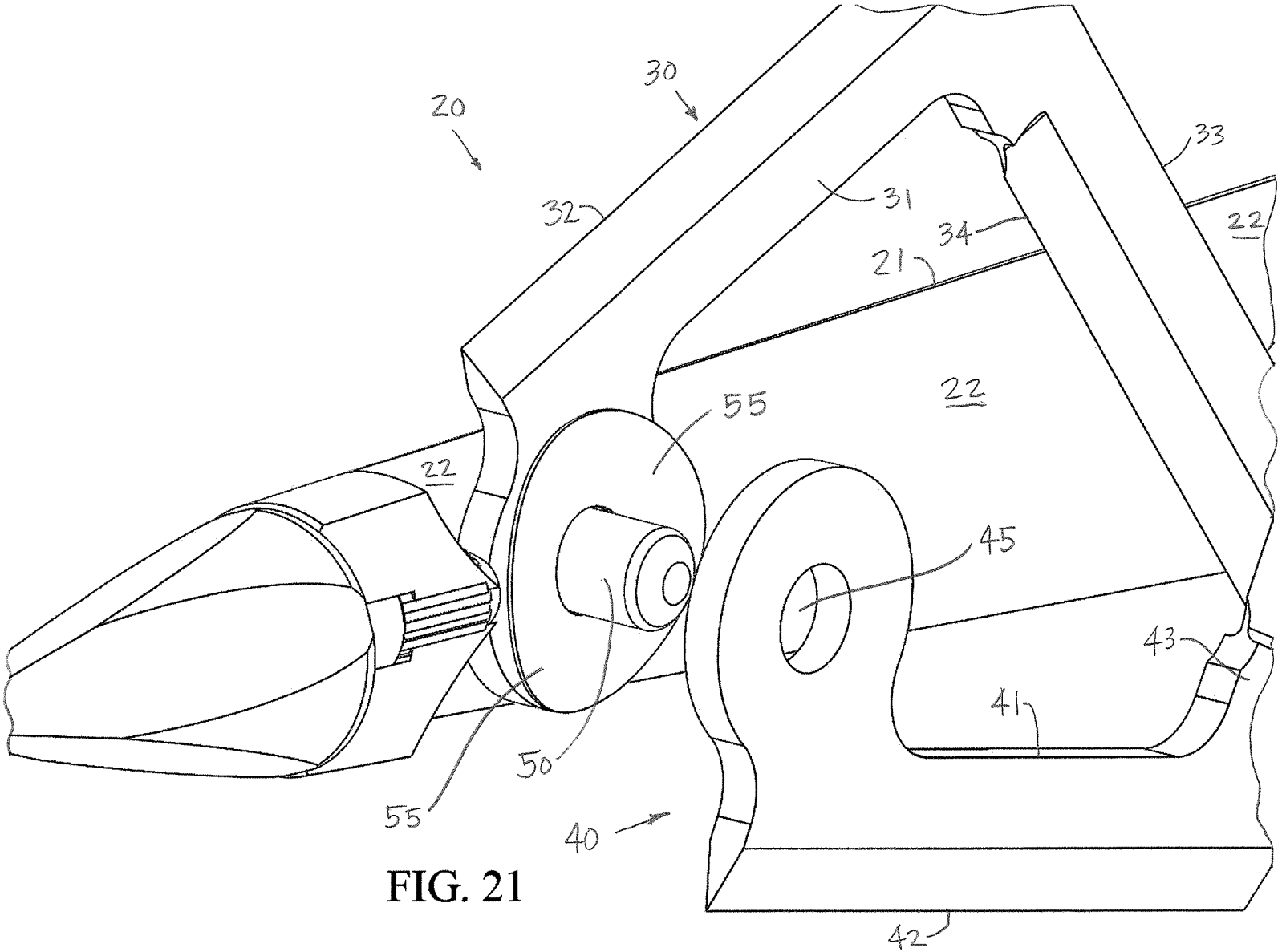
FIG. 21 is a partial perspective view of a mechanical broadhead with a spring element, according to one embodiment of this invention.
Figure 22:
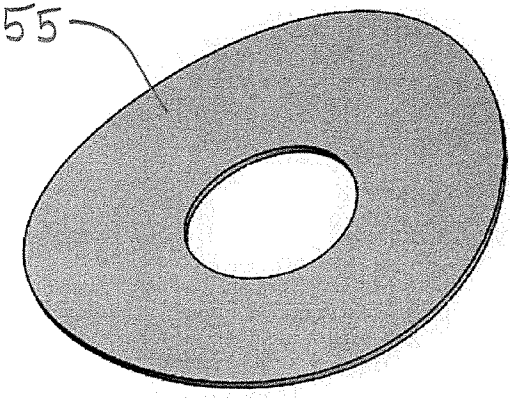
FIG. 22 is a perspective front view of a spring element, according to one embodiment of this invention.
Figure 23:
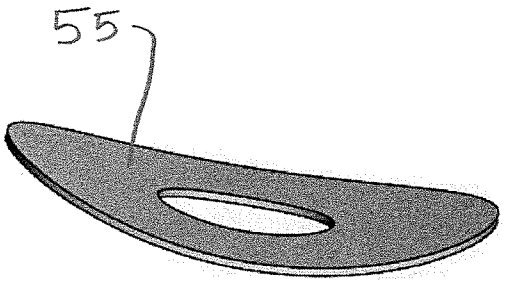
FIG. 23 is a perspective side view of the spring element, as shown in FIG. 22.

In some embodiments of this invention, broadhead 20 further comprises spring element 55, such as shown in FIGS. 21-23, which can be, for example, a wave washer, mounted with respect to blade 30 and/or 40 and/or releasably fixed with respect to blade 30 and/or 40, to provide or supply a bias force to, upon and/or against blade 30 and/or 40, by direct contact and/or indirect contact. In some embodiments of this invention, spring element 55 biases, urges or otherwise forces or moves blade 30 and/or 40 into the retracted position. In some embodiments of this invention, spring element 55 contacts blade 30 and/or 40, directly or indirectly, such as in a frictional manner, a mechanical manner and/or in another engageable manner.

In some embodiments according to this invention, the fit between spring element 55 and blade 30 and/or 40 is relatively tight, resulting in increased friction and thus little or no movement of spring element 55 with respect to blade 30 and/or 40. In other embodiments according to this invention, the fit between spring element 55 and blade 30 is relatively loose, resulting in less friction and some movement of spring element 55 with respect to blade 30 and/or 40. In some embodiments of this invention, spring element 55 piggybacks with, rides with and/or moves with blade 30 and/or 40 as blade 30 and/or 40 pivots and/or otherwise moves with respect to body 21.

Spring element 55 can further comprise a through hole or opening within which pivot 50 is mounted, in some embodiments of this invention. The opening can form a circular bore or a non-circular bore. The clearance between spring element 55 and pivot 50 can be selected to provide either a relatively tight fit or a relatively loose fit between the spring element and pivot 50. Spring element 55 can releasably hold or removably fix blade 30 and/or 40 in the retracted position, such as by spring element 55 having at least one lock tab and contact portion or another similar structure interfering with movement of blade 30 and/or 40 and/or spring element 55.

As shown in FIGS. 21-23, spring element 55 may further comprise a detent and/or raised portion or contact portion which can be integrated with each other or can be separated from each other. In some embodiments according to this invention, the detent and/or raised portion each contacts an outer or skin surface or surface of blade 30 and/or 40. The size, dimensions and/or internal bias force of the detent and/or the raised portion can be varied to provide or supply a desired or a selected bias force acting upon blade 30 and/or 40. In other embodiments of this invention, the detent and/or the raised portion engages within the bore or recess and/or another suitable opening within blade 30 and/or 40 and/or body 20, to releasably hold blade 30 and/or 40 in the retracted position.

In some embodiments according to this invention, an opening force or impact force applied to an impact portion and/or blunt edge of blade 30 and/or 40 transfers forces through blade 30 and/or 40, providing torque about pivot 50 and/or a center axis, to move blade 30 and/or 40 from the retracted position to the expanded position. Features or parts of the impact portion and/or the blunt edge, for example, including but not limited to a moment arm acting at or through blade 30, can be sized and designed to overcome the bias force of spring element 55 and/or the force of any other element and/or structure acting upon and holding or urging blade 30 and/or 40 in the retracted position. Thus, as broadhead 20 enters a target material, spring element 55 and/or blade 30 and/or 40 can be designed to enter the target material with blade 30 and/or 40 in the retracted position and then upon contact between the impact portion and the target material move blade 30 and/or 40 into the expanded position, such as for exposing a sharp edge and/or a cutting portion to and thus cutting the target material.

In some embodiments of this invention, spring element 55 can be a wave washer, an O-ring and/or any other suitable holder, holding device, securing device, retaining device and/or retainer that can be designed and/or used to hold, secure, retain and/or otherwise generally fix a position or a relative position of blade 30 and/or 40, such as in the retracted position, particularly during the extreme forces generated and transferred to or exerted upon blade 30 and/or 40 as broadhead 20 is launched from a bow, such as an archery bow. In some embodiments of this invention, spring element 55, such as the wave washer, the O-ring and/or any other suitable holder has a retaining force or a holding force large enough to overcome the launch forces generated and any other force trying to open blade 30 and/or 40 at launch and/or during flight, and thus hold, retain or fix the position of blade 30 and/or 40 in the in-flight position or the retracted position. However, it is important to also design spring element 55, such as the wave washer, the O-ring and/or any other suitable holder and/or any other component or element of broadhead 20 so that the combined retaining force and/or the combined holding force is overcome at a time of contact or as blade 30 and/or 40 contacts and/or enters the target material. If the retaining force or the holding force is not sufficiently overcome, then it may be possible for blade 30 and/or 40 to not move from the in-flight position or retracted position to the impact position or the expanded position upon contact with and/or entry into the target material.

According to some embodiments of this invention, in the launch position, second section 33 or 43 of blade 30 or 40 is positioned or arranged so that first section 31 or 41 of blade 30 or 40 generally faces outward from the first side of opening 22 and towards a front of body 21 and second section 33 or 43 relatively little or minimally protrudes from or extends beyond the second side of opening 22. In some embodiments of this invention, upon impact, first section 31 or 41 of blade 30 or 40 is forced to rotate or pivot inwardly and causes second section 33 or 43 to rotate or pivot outwardly and thus to effect a wider cutting diameter or width of broadhead 20 as compared to broadhead 20 with first section 31 or 41 in a launch position or an in-flight position. According to some embodiments of this invention, stop 52, such as a stop pin and/or a pivot stop, is fixed, attached, secured and/or otherwise mounted directly to or with respect to body 21 to prevent blade 30 and/or 40 from rotating through or beyond a centerline of body 21. In other embodiments of this invention, there is no stop 52 and blades 30 and/or 40 can rotate, pivot and/or otherwise move with respect to each other and/or with respect to body 21, even beyond the position shown in FIG. 2, for example. In some embodiments where there is no stop 52, blades 30 and/or 40 can be designed, sized, weighted and/or otherwise configured to allow blades 30 and/or 40 to move in a desired fashion. In some embodiments where there is no stop 52, spring element 55 can be used to keep blades 30 and/or 40 in the desired in-flight position and/or the desired impact position. In some embodiments where there is no stop 52, it is possible to prevent blades 30 and/or 40 from binding or catching, for example, when broadhead 20 is removed or pulled from a target or target material.

While in the foregoing detailed description this invention has been described in relation to certain preferred embodiments thereof, and many details have been set forth for purposes of illustration, it will be apparent to those skilled in the art that this invention is susceptible to additional embodiments and that certain of the details described herein can be varied considerably without departing from the basic principles of this invention.

The invention claimed is:

1. A broadhead comprising:

a body having an opening, a first blade mounted within the opening and pivotable with respect to the body, a second blade mounted within the opening and pivotable with respect to the body, the first blade and the second blade movable between an in-flight position and an impact position, in the in-flight position the first blade and the second blade held in an in-flight arrangement with respect to the body, in the impact position the first blade and the second blade moved away from the in-flight arrangement, the first blade and the second blade each having a first section generally perpendicular to a second section, and in the in-flight position the first section having a first cutting portion oriented in a forward direction and the second section having a second cutting portion oriented in the forward direction.

2. The broadhead according to claim 1, wherein the opening in the blade is a slot arranged along a longitudinal axis of the body and the slot extends between a first outer surface and a second outer surface of the body.

3. The broadhead according to claim 1, wherein in the impact position the first cutting portion is arranged away from the forward direction and the second cutting portion remains oriented in the forward direction.

4. The broadhead according to claim 1, wherein in the impact position substantially all of a first section of each of the first blade and the second blade is housed within the opening.

5. The broadhead according to claim 1, wherein a stop is secured with respect to the body, in the impact position the first blade and the second blade contact the stop, and in the in-flight position the first blade and the second blade do not contact the stop.

6. The broadhead according to claim 1, wherein a first thickness of the first blade is less than a first width of the first blade and a second thickness of the second blade is less than a second width of the second blade.

7. The broadhead according to claim 1, wherein the first blade and the second blade each is rotatably mounted about a pivot secured with respect to the body.

8. The broadhead according to claim 1, wherein the first blade and the second blade pivot with respect to the body so that a first cutting diameter of the broadhead in the impact position is greater than a second cutting diameter of the broadhead in the in-flight position.

9. A broadhead comprising:

a body having an opening, a first blade and a second blade each mounted to pivot with respect to each other and with respect to the body, the first blade and the second blade movably mounted within the opening, the first blade and the second blade moving between an in-flight position and an impact position, in the impact position the first blade and the second blade held with respect to the body, in the in-flight position the first blade and the second blade moving with respect to the body, the first blade and the second blade each having a first section generally perpendicular to a second section, and in the in-flight position the first section having a first cutting portion oriented in a forward direction and the second section having a second cutting portion oriented in the forward direction.

10. The broadhead according to claim 9, wherein in the in-flight position the first section of the first blade has a first cutting portion oriented in the forward direction and the second section of the first blade has a second cutting portion oriented in the forward direction.

11. The broadhead according to claim 10, wherein in the impact position the first cutting portion is oriented away from the forward direction and the second cutting portion remains oriented in the forward direction.

12. The broadhead according to claim 9, wherein a first thickness of the first blade is less than a first width of the first blade and a second thickness of the second blade is less than a second width of the second blade.

13. The broadhead according to claim 12, wherein the first blade and the second blade each is rotatably mounted about a pivot secured with respect to the body.

14. The broadhead according to claim 9, wherein the first blade and the second blade pivot with respect to the body so that a first cutting diameter of the broadhead in the impact position is greater than a second cutting diameter of the broadhead in the in-flight position.

15. A method for pivoting a first blade and a second blade of a broadhead, the method comprising:

pivoting the first blade within an opening of a body;

pivoting the second blade within the opening of the body;

moving the first blade and the second blade between an in-flight position and an impact position of the broadhead;

in the impact position holding the first blade and the second blade with respect to the body; and in the in-flight position moving the first blade and the second blade with respect to the body;

wherein the first blade and the second blade each has a first section generally perpendicular to a second section, and in the in-flight position the first section has a first cutting portion oriented in a forward direction and the second section has a second cutting portion oriented in the forward direction.

16. The method according to claim 15, wherein in the in-flight position the first section has a first cutting portion oriented in a forward direction and the second section has a second cutting portion oriented in the forward direction.

17. The method according to claim 16, wherein in the impact position the first cutting portion is oriented away from the forward direction and the second cutting portion remains oriented in the forward direction.

18. The method according to claim 15, wherein in the impact position substantially all of the first section of each of the first blade and the second blade is housed within the opening.

19. The broadhead according to claim 15, wherein a first thickness of the first blade is less than a first width of the first blade and a second thickness of the second blade is less than a second width of the second blade.

* * * * *